US009826304B2

(12) United States Patent
Akino

(10) Patent No.: US 9,826,304 B2
(45) Date of Patent: Nov. 21, 2017

(54) STEREO MICROPHONE

(71) Applicant: Hiroshi Akino, Tokyo (JP)

(72) Inventor: Hiroshi Akino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 0 days.

(21) Appl. No.: 15/014,121

(22) Filed: Feb. 3, 2016

(65) Prior Publication Data

US 2016/0286307 A1 Sep. 29, 2016

(30) Foreign Application Priority Data

Mar. 26, 2015 (JP) ..... 2015-064607

(51) Int. Cl.

| | |
|---|---|
| ***H04R 1/08*** | (2006.01) |
| ***H04R 1/40*** | (2006.01) |
| ***H04R 5/027*** | (2006.01) |
| *H04R 3/00* | (2006.01) |

(52) U.S. Cl.

CPC ..... *H04R 1/406* (2013.01); *H04R 5/027* (2013.01); *H04R 3/005* (2013.01)

(58) Field of Classification Search

CPC ... H04R 5/00; H04R 1/08; H04R 9/08; H04R 11/04; H04R 17/02; H04R 21/02

USPC ..... 381/26, 355–356, 176

See application file for complete search history.

(56) References Cited

U.S. PATENT DOCUMENTS

| | | | | |
|---|---|---|---|---|
| 3,619,517 A * | 11/1971 | Bleazey | H04R 1/222 381/176 |
| 6,366,679 B1 * | 4/2002 | Steffen | H04H 20/88 381/356 |
| 6,434,252 B1 * | 8/2002 | Royer | H04R 9/048 381/176 |
| RE38,350 E * | 12/2003 | Godfrey | H04R 1/08 381/356 |
| 6,845,163 B1 * | 1/2005 | Johnston | H04R 1/406 381/122 |
| 8,976,977 B2 * | 3/2015 | De Sena | H04R 3/005 381/26 |
| 2011/0317862 A1 * | 12/2011 | Hosoe | H04R 1/406 381/356 |

FOREIGN PATENT DOCUMENTS

| | | |
|---|---|---|
| JP | 5574494 | 8/2014 |

* cited by examiner

*Primary Examiner* — Suhan Ni
(74) *Attorney, Agent, or Firm* — Whitham, Curtis & Cook, P.C.

(57) ABSTRACT

A stereo microphone includes an omnidirectional microphone unit, a bidirectional side-channel microphone unit arranged to be perpendicular to a direction of a sound collecting axis outside the omnidirectional microphone unit, a right-channel microphone unit arranged to form a predetermined angle with respect to the side-channel microphone unit on a plane including the sound collecting axis outside the omnidirectional microphone unit, and a left-channel microphone unit arranged to form a predetermined angle with respect to the side-channel microphone unit and the right-channel microphone unit on the plane including the sound collecting axis outside the omnidirectional microphone unit.

9 Claims, 5 Drawing Sheets

STEREO MICROPHONE

BACKGROUND OF THE INVENTION

Technical Field

The present invention relates to a stereo microphone.

Background Art

As a stereo sound collecting method that can obtain favorable response characteristics of a directional frequency, sound collecting methods such as an XY method and an MS method, in which a plurality of microphone units is closely arranged, are known.

In the XY method, a right-channel unidirectional microphone unit and a left-channel unidirectional microphone unit are arranged to face the right and left, respectively. In the MS method, a mid-channel unidirectional microphone unit and a side-channel bidirectional microphone unit are arranged to have their directional axes be perpendicular to each other.

JP 5574494 B describes a stereo microphone in which right-channel ribbon microphone units and left-channel ribbon microphone units are alternately arranged in a circumferential direction, and an angle made by directional axes of the ribbon microphone units is 90 degrees.

Although the XY method and the MS method have their advantages, the types and the arrangements of the microphone units necessary in the respective methods are different. Therefore, it is difficult to obtain stereo sounds by a plurality of sound collecting methods, with a single stereo microphone.

SUMMARY OF INVENTION

An object of the present invention is to provide a stereo microphone that can obtain stereo sounds by a plurality of sound collecting methods.

According to the present invention, there is provided a stereo microphone including: an omnidirectional microphone unit; a bidirectional side-channel microphone unit arranged to be perpendicular to a direction of a sound collecting axis outside the omnidirectional microphone unit; a bidirectional right-channel microphone unit arranged to forma predetermined angle with respect to the side-channel microphone unit on a plane including the sound collecting axis outside the omnidirectional microphone unit; and a bidirectional left-channel microphone unit arranged to forma predetermined angle with respect to the side-channel microphone unit and the right-channel microphone unit on the plane including the sound collecting axis outside the omnidirectional microphone unit.

DESCRIPTION OF THE PREFERRED EMBODIMENTS

[Stereo Microphone (1)]

Hereinafter, an embodiment of a stereo microphone according to the present invention will be described with reference to the drawings.

<Arrangement of Stereo Microphone>

Figure 1:
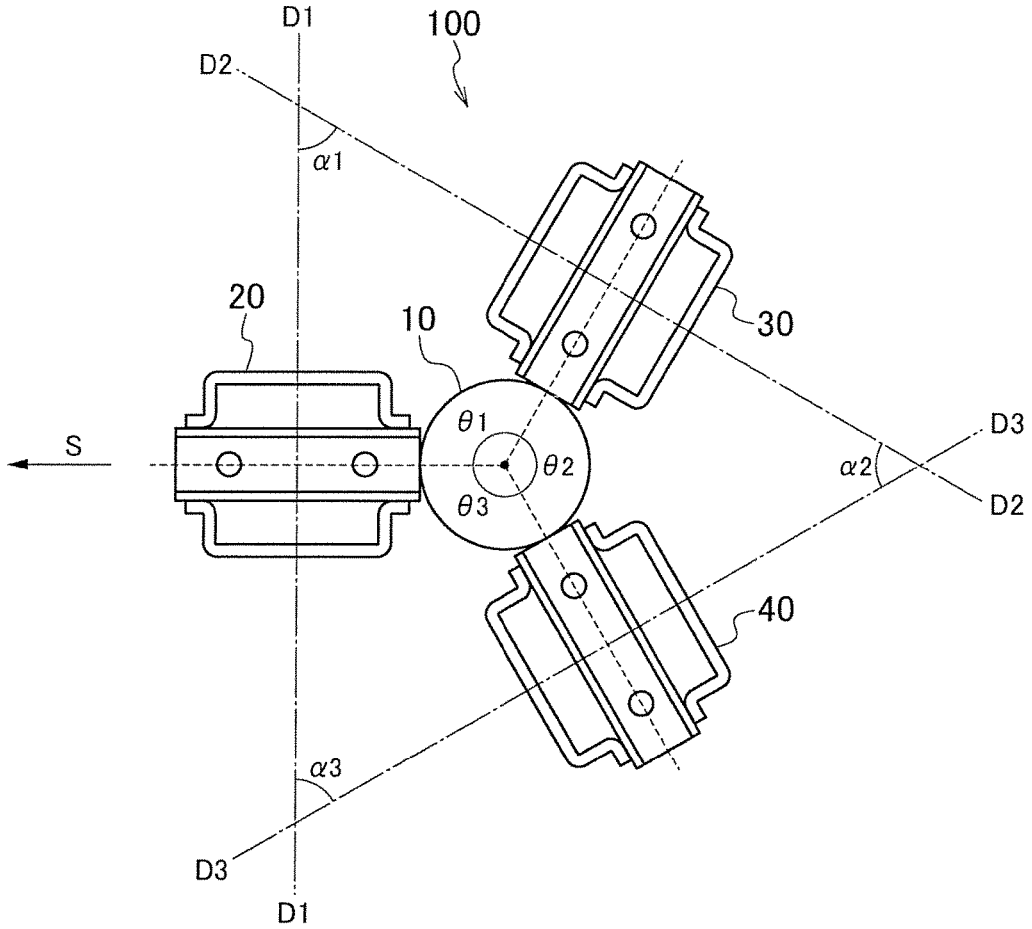
FIG. 1 is a plan view illustrating an embodiment of a stereo microphone according to the present invention.

As illustrated in FIG. 1, a stereo microphone 100 according to the present embodiment collects sounds mainly in a direction of a sound collecting axis S. The stereo microphone 100 includes an omnidirectional microphone unit 10. The stereo microphone 100 includes a side-channel microphone unit 20, a right-channel microphone unit 30, and a left-channel microphone unit 40 outside the omnidirectional microphone unit 10.

As the omnidirectional microphone unit 10, a capacitor microphone unit is used, for example. Note that, as the omnidirectional microphone unit 10, microphone units other than the capacitor microphone unit can be used.

The side-channel microphone unit 20, the right-channel microphone unit 30, and the left-channel microphone unit 40 are bidirectional microphone units respectively. As the side-channel microphone unit 20, the right-channel microphone unit 30, and the left-channel microphone unit 40, ribbon microphone units are used, for example.

The side-channel microphone unit 20 is arranged to have a directional axis D1 be perpendicular to the sound collecting axis S of the stereo microphone 100.

The right-channel microphone unit 30 is arranged to form a predetermined angle $\theta 1$ (for example, 120°) with respect to the side-channel microphone unit 20 on a plane including the sound collecting axis S. A directional axis D2 of the right-channel microphone unit 30 is arranged to form a predetermined angle $\alpha 1$ (for example, 60°) with respect to the directional axis D1 of the side-channel microphone unit 20 on the plane including the sound collecting axis S.

The left-channel microphone unit 40 is arranged to form a predetermined angle $\theta 2$ (for example, 120°) with respect to the right-channel microphone unit 30 on the plane including the sound collecting axis S. A directional axis D3 of the left-channel microphone unit 40 is arranged to form a predetermined angle $\alpha 2$ (for example, 60°) with respect to the directional axis D2 of the right-channel microphone unit 30 on the plane including the sound collecting axis S.

Further, the left-channel microphone unit 40 is arranged to form a predetermined angle $\theta 3$ (for example, 120°) with respect to the side-channel microphone unit 20 on the plane including the sound collecting axis S. The directional axis D3 of the left-channel microphone unit 40 is arranged to form a predetermined angle $\alpha 3$ (for example, 60°) with respect to the directional axis D1 of the side-channel microphone unit 20 on the plane including the sound collecting axis S.

The right-channel microphone unit 30 and the left-channel microphone unit 40 are arranged on the same plane with an equal angle with respect to the side-channel microphone unit 20. That is, a figure formed of lines that connect intersection points where two of the three directional axes D1, D2, and D3 intersect with each other, respectively, is an equilateral triangle, and the omnidirectional microphone unit 10 is arranged in the center (the center of gravity) of the equilateral triangle.

Note that the angles $\theta 1$, $\theta 2$, and $\theta 3$ can be set to unequal angles unlike the above description. For example, any one of the angles $\theta 1$, $\theta 2$, and $\theta 3$ may be set to a different angle from two other angles, or the angles $\theta 1$, $\theta 2$, and $\theta 3$ may be set to mutually different angles.

Figure 2A:
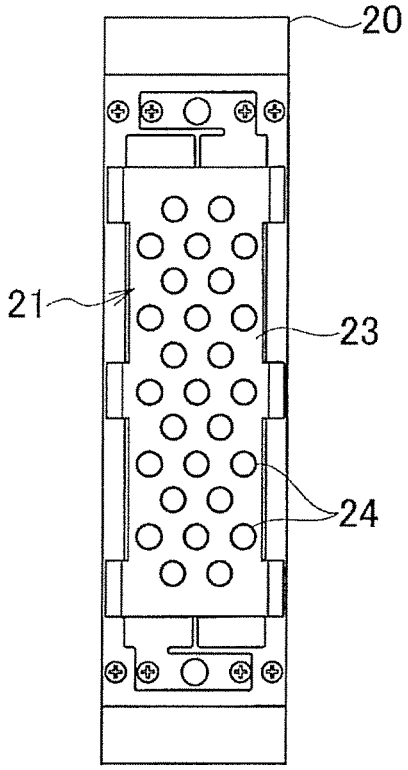
FIG. 2A is a front view illustrating an appearance of a ribbon microphone unit.
Figure 2B:
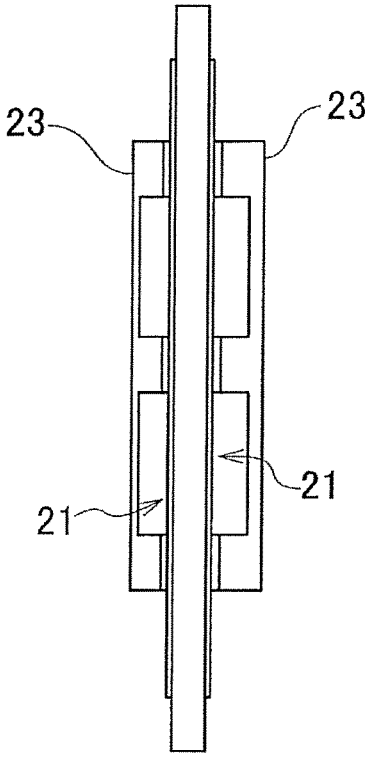
FIG. 2B is a side view illustrating an appearance of the ribbon microphone unit.

A front view illustrating an appearance of the ribbon microphone unit used as the side-channel microphone unit 20 is illustrated in FIG. 2A, and a side view is illustrated in FIG. 2B, respectively.

As illustrated in FIG. 2B, in the side-channel microphone unit 20, rectangular ribbon-shaped diaphragms 21 are arranged with a space in parallel to each other. Further, in the side-channel microphone unit 20, protection plates 23 that protect the respective ribbon-shaped diaphragms 21 are arranged. As illustrated in FIG. 2A, a plurality of holes 24 is formed in the protection plates 23. The holes 24 allow sound waves to pass through. The sound waves having passed through the holes 24 vibrate the ribbon-shaped diaphragms 21.

The vibrated ribbon-shaped diaphragms 21 cross a magnetic flux of a magnetic field generated by permanent magnets arranged at both sides of the ribbon-shaped diaphragms 21. Then, the ribbon-shaped diaphragms 21 generate electrical signals corresponding to the sound waves. In this way, the side-channel microphone unit 20 performs electroacoustic conversion.

Note that the right-channel microphone unit 30 and the left-channel microphone unit 40 have a similar structure to the ribbon microphone unit used for the side-channel microphone unit 20. Therefore, description is omitted.

Figure 3:
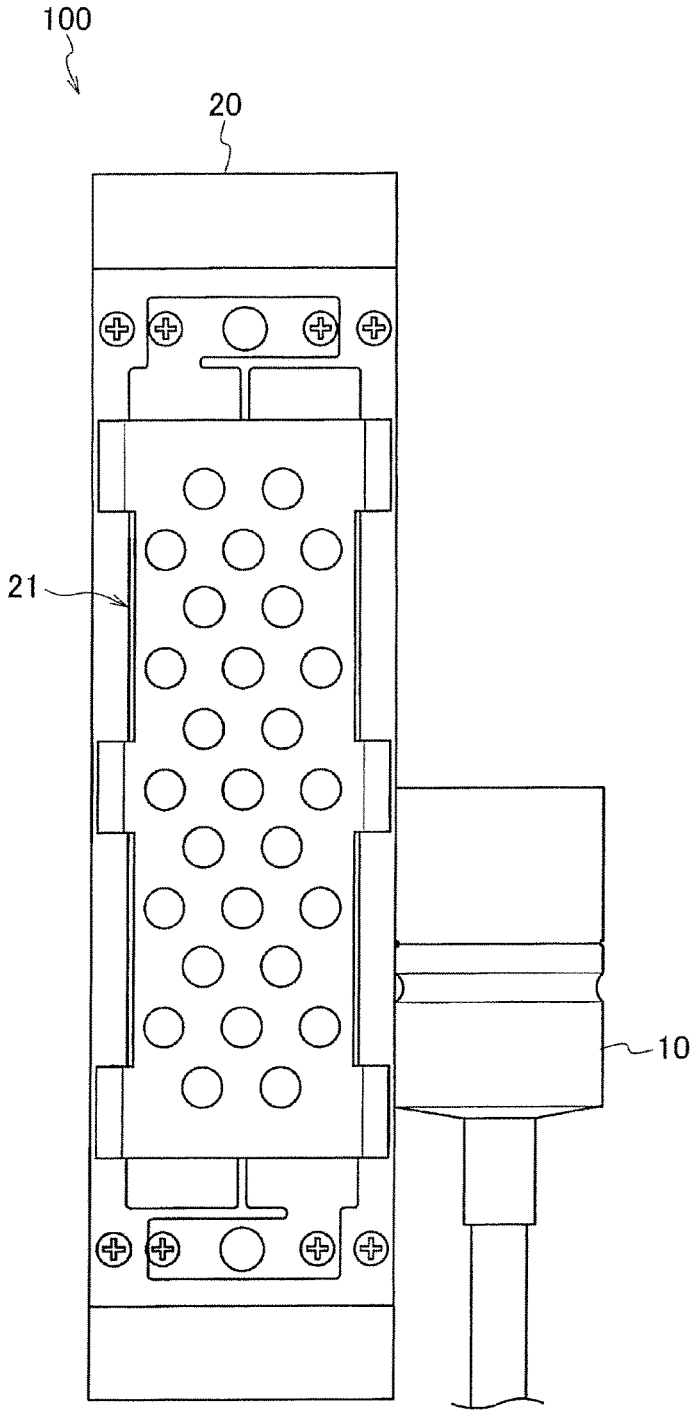
FIG. 3 is a side view of the stereo microphone of FIG. 1.

FIG. 3 is a side view of the stereo microphone 100, and only the omnidirectional microphone unit 10 and the side-channel microphone unit 20 are illustrated. As illustrated in FIG. 3, in the stereo microphone 100, an acoustic terminal of the omnidirectional microphone unit 10 is arranged to be positioned near a middle in a longitudinal direction of the diaphragms 21 of the side-channel microphone unit 20. As for the right-channel microphone unit 30 and the left-channel microphone unit 40, the acoustic terminals of the omnidirectional microphone unit 10 are positioned near the middles in the longitudinal direction of the diaphragms 21. The acoustic terminal indicates a position of the air. The air provides an effective sound pressure to the microphone unit 10, 20, 30 and 40. In other words, the acoustic terminal is a center position of the air simultaneously moving with the diaphragm included in the microphone units.

<Circuit Configuration of Stereo Microphone>

Figure 4:
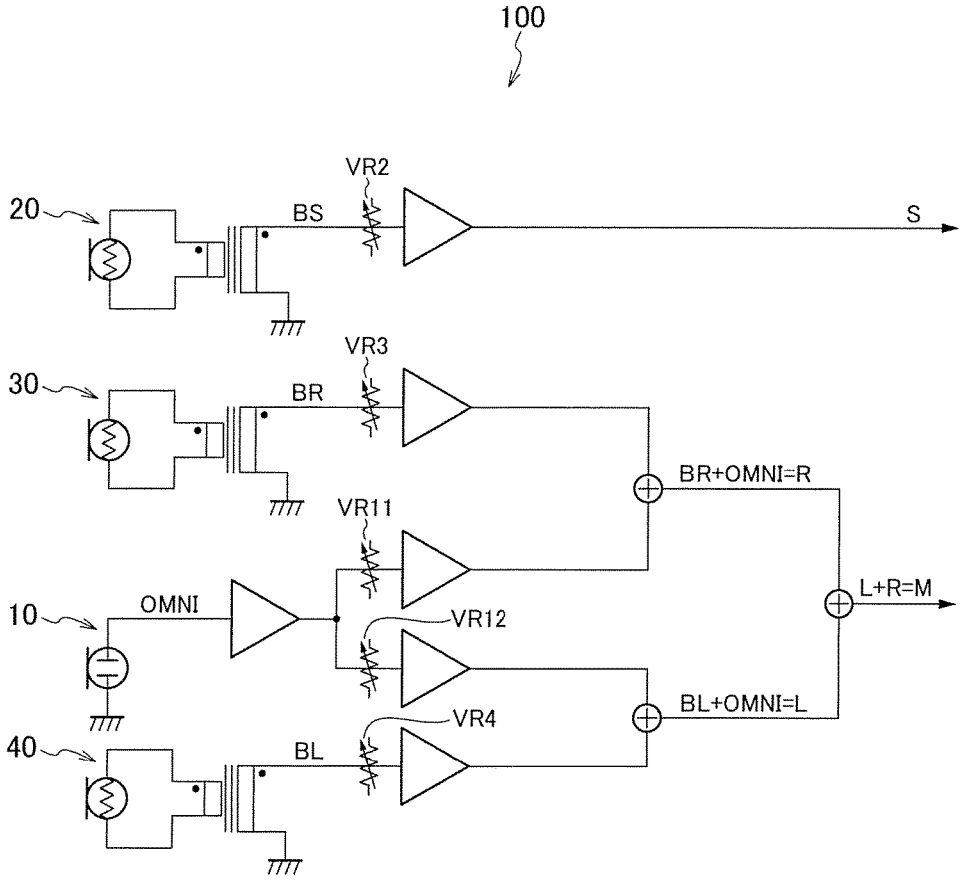
FIG. 4 is a circuit diagram of the stereo microphone of FIG. 1.

FIG. 4 illustrates a circuit diagram of the stereo microphone 100. In the stereo microphone 100, an output OMNI of the omnidirectional microphone unit 10 goes through an impedance converter and is separated into two systems. Output levels of the separated outputs OMNI are respectively adjusted independently of each other with a variable resistance VR11 and a variable resistance VR12 in the respective systems, and respectively go through buffer amplifiers and are output.

An output BS of the side-channel microphone unit 20 goes through a transformer, and an output level thereof can then be adjusted with a variable resistance VR2. The output BS of the side-channel microphone unit 20 goes through a buffer amplifier to become an output S of a side signal of the stereo microphone 100.

An output BR of the right-channel microphone unit 30 goes through a transformer different from the aforementioned transformer, and an output level thereof can then be adjusted with a variable resistance VR3. The output BR of the right-channel microphone unit 30 goes through a buffer amplifier, and is then added to one of the outputs OMNI of the omnidirectional microphone unit 10 (BR+OMNI) to become an output R of a right signal of the stereo microphone 100.

An output BL of the left-channel microphone unit 40 goes through a transformer different from the aforementioned transformers, and an output level thereof can then be adjusted with a variable resistance VR4. The output BL of the left-channel microphone unit 40 goes through a buffer amplifier, and is then added to one of the outputs OMNI of the omnidirectional microphone unit 10 (BL+OMNI) to become an output L of a left signal of the stereo microphone 100.

With the arrangement of the omnidirectional microphone unit 10 and the right-channel microphone unit 30 illustrated in FIG. 1, the output R of the right signal forms a cardioid having a directional axis in a direction of 60° with respect to the directional axis D1. Further, with the arrangement of the omnidirectional microphone unit 10 and the left-channel microphone unit 40, the output L of the left signal forms a cardioid having a directional axis in a direction of −60° with respect to the directional axis D1. That is, the stereo microphone 100 can obtain an output of the XY method by the output R of the right signal and the output L of the left signal.

The directional axes of the output R of the right signal and the output L of the left signal can be set with the directions of the directional axes D2 and D3 of the right-channel microphone unit 30 and the left-channel microphone unit 40. Further, the directional axes of the output R of the right signal and the output L of the left signal can be set by adjusting the output levels with the variable resistances VR11, VR12, VR3, and VR4.

Further, when the output R of the right signal and the output L of the left signal are added (R+L) in the stereo microphone 100, the added output become an output M of a signal (mid signal) of a mid channel. The stereo microphone 100 can obtain an output of the MS method with the output M of the mid signal and the output S of the side-channel microphone unit 20.

As described above, the stereo microphone 100 according to the present embodiment can easily obtain the stereo sound by the plurality of sound collecting methods (the MS method and the XY method) by performing addition processing of the outputs of the right and left signals.

Further, the stereo microphone 100 according to the present embodiment can switch the plurality of stereo sound collecting methods.

Further, the stereo microphone 100 according to the present embodiment can set the direction of the directional axis by changing the arrangement of the microphone units on the plane including the sound collecting axis S and the setting of the output levels of the variable resistances.

[Stereo Microphone (2)]

Hereinafter, another embodiment of a stereo microphone according to the present invention will be described, mainly about different points from the above-described embodiment.

Figure 5:
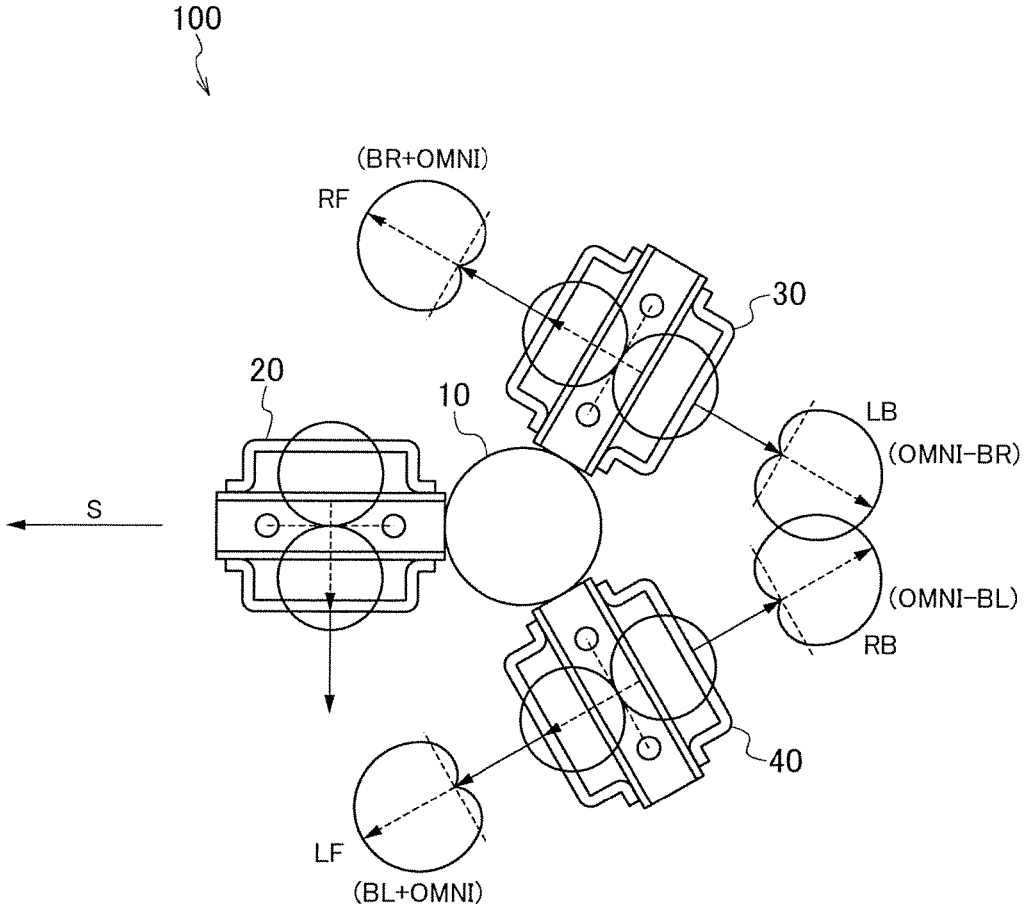
FIG. 5 is a plan view illustrating another embodiment of a stereo microphone according to the present invention.

An arrangement of microphone units in a stereo microphone 100 according to the present embodiment is similar to that in the above-described embodiment. That is, in the stereo microphone 100 illustrated in FIG. 5, a side-channel microphone unit 20, a right-channel microphone unit 30, and a left-channel microphone unit 40 are arranged with an equal angle to each other on a plane including a sound collecting axis S.

An output BR of the right-channel microphone unit 30 is added to one of outputs OMNI of an omnidirectional microphone unit 10 (BR+OMNI) to become an output RF of a right front signal of the stereo microphone 100.

An output BL of the left-channel microphone unit 40 is added to one of outputs OMNI of the omnidirectional microphone unit 10 (BL+OMNI) to become an output LF of a left front signal of the stereo microphone 100.

In the present embodiment, the output BR of the right-channel microphone unit 30 is subtracted from the output OMNI of the omnidirectional microphone unit 10 (OMNI−BR), so that an output LB of a left rear channel of the stereo microphone 100 can be obtained.

Similarly, the output BL of the left-channel microphone unit 40 is subtracted from the output OMNI of the omnidirectional microphone unit 10 (OMNI−BL), so that an output RB of a right rear channel of the stereo microphone 100 can be obtained. Note that levels of the outputs BS, BR, BL, and OMNI of the microphone units may be adjusted with variable resistances, similarly to the first embodiment.

The addition/subtraction processing of the outputs of the microphone units is performed as described above, whereby the stereo microphone 100 can obtain the outputs LB and RB of the right and left rear sounds, in addition to the right and left front outputs RF and LF in the direction of ±60° with respect to the sound collecting axis S.

As described above, the stereo microphone 100 according to the present embodiment can obtain the outputs of the rear sounds by the subtraction processing of the outputs, in addition to the aforementioned description, and thus can perform three-dimensional sound collection.

What is claimed is:

1. A stereo microphone comprising:

an omnidirectional microphone unit;

a bidirectional side-channel microphone unit arranged to be perpendicular to a direction of a sound collecting axis outside the omnidirectional microphone unit;

a bidirectional right-channel microphone unit arranged to form a predetermined angle with respect to the side-channel microphone unit on a plane including the sound collecting axis outside the omnidirectional microphone unit; and a bidirectional left-channel microphone unit arranged to form a predetermined angle with respect to the side-channel microphone unit and the right-channel microphone unit on the plane including the sound collecting axis outside the omnidirectional microphone unit, wherein the predetermined angle of the bidirectional right-channel microphone unit with respect to the side-channel microphone unit, and the predetermined angle of the bidirectional left-channel microphone unit with respect to the side-channel microphone unit and the right-channel microphone unit are 120°, a directional axis of the right-channel microphone unit is arranged to form 60° with respect to a directional axis of the side-channel microphone unit on the plane including the sound collecting axis, a directional axis of the left-channel microphone unit is arranged to form 60° with respect to the directional axis of the right-channel microphone unit on the plane including the sound collecting axis, the directional axis of the left-channel microphone unit is arranged to form 60° with respect to the directional axis of the side-channel microphone unit on the plane including the sound collecting axis, and a figure formed of lines that connect intersection points where two of the directional axes of the right-channel microphone unit, the left-channel microphone unit, and the side-channel microphone unit intersect with each other, respectively, is an equilateral triangle, and the omnidirectional microphone unit is arranged in a center of the equilateral triangle.

2. The stereo microphone according to claim 1, wherein an output of a right channel is obtained by adding an output of the omnidirectional microphone unit and an output of the right-channel microphone unit, an output of a left channel is obtained by adding the output of the omnidirectional microphone unit and an output of the left-channel microphone unit, and an output of a mid channel is obtained by adding the output of the right channel and the output of the left channel.

3. The stereo microphone according to claim 2, wherein the output of the right channel and the output of the left channel configure a stereo sound collecting method that is an XY method.

4. The stereo microphone according to claim 2, wherein the output of the mid channel and an output of the side-channel microphone unit configure a stereo sound collecting method that is an MS method.

5. The stereo microphone according to claim 1, wherein output levels of the omnidirectional microphone unit, an output level of the right-channel microphone unit, and an output level of the left-channel microphone unit are adjusted to adjusted outputs and the adjusted outputs are added.

6. The stereo microphone according to claim 1, wherein the side-channel microphone unit, the right-channel microphone unit, and the left-channel microphone unit are arranged with an equal angle on the plane including the sound collecting axis.

7. The stereo microphone according to claim 1, wherein an output of a right rear channel is obtained by subtracting the output of the left-channel microphone unit from the output of the omnidirectional microphone unit, and an output of a left rear channel is obtained by subtracting the output of the right-channel microphone unit from the output of the omnidirectional microphone unit.

8. The stereo microphone according to claim 7, wherein an output of a right front channel is obtained by adding an output of the omnidirectional microphone unit and an output of the right-channel microphone unit, an output of a left front channel is obtained by adding the output of the omnidirectional microphone unit and an output of the left-channel microphone unit.

9. The stereo microphone according to claim 1, wherein the side-channel microphone unit, the right-channel microphone unit, and the left-channel microphone unit are ribbon microphone units, and acoustic terminals of the omnidirectional microphone unit are arranged to be positioned near middles in a longitudinal direction of diaphragms of the ribbon microphone units.

* * * * *